US009133618B2

(12) United States Patent
Janakiram

(10) Patent No.: US 9,133,618 B2
(45) Date of Patent: Sep. 15, 2015

(54) METHOD AND SYSTEM FOR FABRICATING A NON LOAD BEARING PARTITION WALL

(71) Applicant: Kartik Janakiram, Mysore (IN)

(72) Inventor: Kartik Janakiram, Mysore (IN)

(73) Assignee: Kartik Janakiram, Mysore (IN)

( * ) Notice: Subject to any disclaimer, the term of this patent is extended or adjusted under 35 U.S.C. 154(b) by 0 days.

(21) Appl. No.: 14/460,360

(22) Filed: Aug. 15, 2014

(65) Prior Publication Data

US 2015/0047277 A1 Feb. 19, 2015

(51) Int. Cl.

| | |
|---|---|
| ***E04C 2/52*** | (2006.01) |
| ***E04B 2/72*** | (2006.01) |
| ***E04C 2/06*** | (2006.01) |
| ***E04C 5/01*** | (2006.01) |
| ***E04C 5/07*** | (2006.01) |
| ***E04C 5/10*** | (2006.01) |
| ***E04C 5/12*** | (2006.01) |
| *E04B 2/86* | (2006.01) |
| *E04B 2/74* | (2006.01) |

(52) U.S. Cl.

CPC . *E04B 2/721* (2013.01); *E04C 2/06* (2013.01); *E04C 5/012* (2013.01); *E04C 5/073* (2013.01); *E04C 5/10* (2013.01); *E04C 5/12* (2013.01); *E04B 2/8623* (2013.01); *E04B 2002/7488* (2013.01)

(58) Field of Classification Search

CPC ..... E04B 1/161; E04B 2/702; E04B 1/16

USPC ..... 52/220.8, 223.7, 223.13, 292, 299, 272

See application file for complete search history.

(56) References Cited

U.S. PATENT DOCUMENTS

| | | | | | |
|---|---|---|---|---|---|
| 3,013,642 | A | * | 12/1961 | Hammitt et al. | 52/238.1 |
| 3,066,770 | A | * | 12/1962 | Millard et al. | 52/220.7 |
| 3,160,244 | A | * | 12/1964 | Kushner et al. | 52/27 |
| 3,166,802 | A | * | 1/1965 | Schmidgall | 52/272 |
| 3,314,202 | A | * | 4/1967 | Rolen | 52/272 |
| 3,662,506 | A | * | 5/1972 | Dillon | 52/251 |
| 4,145,861 | A | * | 3/1979 | Yarnick | 52/741.15 |
| 4,627,205 | A | * | 12/1986 | Hitchins | 52/294 |
| 6,202,374 | B1 | * | 3/2001 | Cooper et al. | 52/220.3 |
| 6,330,773 | B1 | * | 12/2001 | MacDonald et al. | 52/239 |
| 6,401,400 | B1 | * | 6/2002 | Elliott | 52/20 |

* cited by examiner

*Primary Examiner* — Basil Katcheves

(74) *Attorney, Agent, or Firm* — Barry Choobin; Patent360 LLC

(57) ABSTRACT

The embodiments herein disclose a method and system for fabricating a non load bearing partition wall with an internal cavity having partition. The non load bearing partition wall comprises at-least two pre-cast concrete panels arranged in back to back fashion. The pre-cast concrete panel comprises several ribs for enhancing the stiffness matrix. The two ribs are adopted at the two opposite edges of the pre-cast concrete panel and one rib is adopted at the center. The non load bearing partition wall comprises a cavity formed between the pre-cast concrete wall panels. The cavity uses the concept of monolithic property to prevent bending along the width and length, with a special method of anchorage. The panel comprises an inbuilt duct facility to add service fixtures and also to allow for modifications after installation.

13 Claims, 19 Drawing Sheets

METHOD AND SYSTEM FOR FABRICATING A NON LOAD BEARING PARTITION WALL

CROSS-REFERENCE TO RELATED APPLICATIONS

The present application claims the priority of the Indian Provisional Patent Application with serial number 3627/CHE/2013 filed on Aug. 16, 2013 with the title "Method and System for Fabricating a Non Load Bearing Partition Wall", and the contents of which are incorporated by reference herein.

BACKGROUND

1. Technical Field

The embodiments herein are generally related to construction industry and particularly related to pre-cast walls used in the construction industry. The embodiments herein are more particularly related to a method and system for fabricating a non load bearing partition wall with an internal cavity partition.

2. Description of the Related Art

Masonry is a commonly used technique for building the structures. Masonry is the building of structures from individual units laid in and bound together by mortar or any other alternative material. With the shortage of labor being faced and cost escalations, the projects are executed behind schedule. The self weight of the material influences the design criteria for the structure to become uneconomically.

The masonry structure takes time to build. It cannot be built more than one meter per day. It is labor intensive. If the masonry structure is to be built over one meter in a day, staging is required and additional labor is also required to lift the block and give the block to the mason to build the same. It becomes very difficult and labor intensive to build the masonry wall. The work output gets reduced and a cost of construction also goes up. Moreover, a time of construction is also pushed further thereby delaying the schedule of the project.

Normally, after the structure has been build to a required height, the constructed structure same has to be left for a required period of time for curing. By curing, the site gets wet and a starting of other works subsequently on a same day becomes very difficult. In general, after masonry has been built and gained enough strength, an electrical groove cutting and a junction box fixing are done by chipping into the masonry structure. By doing so, the strength of the masonry gets reduced. Since the procedure of chipping involves hammering, it progresses into micro cracks into the masonry structure. After a complete chipping has been done, laying of electrical wiring, switch box, junction box, etc., are carried out. Once this is done, the grooves along the wall through which the conduits have been laid have got to be packed with cement and mortar, and a mesh is put over the same. The filling in the grooves has to be cured for a specific period of time. Once this is completed, an internal plastering of the wall is started, and which are again, labor intensive. After the plastering is completed, the plastered surface is to be left to be cured for a period of 10 days.

One of the existing prior arts discloses a method of constructing walls in a building by using the precast technologies. The method disclosed herein uses the tilt-up concrete panels which increase a life of the structure as they are manufactured under a controlled environment. Commercially, the thickness of the precast wall panels ranges from 100 mm to 200 mm. But, the precast concrete panels are heavy and difficult to be transported. Then the bore holes are made through the concrete panels, and groove cutting is done on the plastered wall to accommodate the plumbing pipes and electrical lines. After laying the plumbing pipe and electrical conduit, once again a coat of plastering is to be done thereby simply wasting material and labor. If there is any maintenance to be done in the plumbing line, the entire wall is to be chipped and, there will be remarkable damages and the damages are to be fixed again in the process of chipping.

Hence there exists a need for a method and system to provide a lighter and a twin wall with a required strength thereby facilitating an infrastructure for the services to be embedded into the walls, preserving design details, allowing for a rapid construction and helping in reducing a volume of raw material consumed. Also, there exists a need for a method and system for fabricating a non load bearing partition wall with an internal cavity portion with partitions.

The above mentioned shortcomings, disadvantages and problems are addressed herein and which will be understood by reading and studying the following specification.

OBJECTIVES OF THE EMBODIMENTS

The primary objective of the embodiments herein is to provide a method and system for fabricating a non load bearing partition wall with an internal cavity portion with partitions.

Another object of the embodiments herein is to provide a non load bearing partition wall with a plurality of pre-defined holes in the precast concrete panels to avoid unwanted groove gutting and chipping operations.

Yet another object of the embodiments herein is to provide a non load bearing partition wall with an enhanced moment of inertia to prevent a bending of the partition wall.

Yet another object of the embodiments herein is to provide a non load bearing partition wall with a twin wall concept, for including a predefined ducting for services to run through.

Yet another object of the embodiments herein is to provide a non load bearing partition wall with one or more ribs to enhance a stiffness matrix of the wall panel.

These and other objects and advantages of the embodiments herein will become readily apparent from the following detailed description taken in conjunction with the accompanying drawings.

SUMMARY

The various embodiments herein provide a method and system for fabricating a non load bearing partition wall with an internal cavity portion with partitions. The system comprises at-least two pre-cast concrete panels and the two precast concrete panels are arranged in back to back fashion. Each pre-cast concrete panel comprises a top portion, a bottom portion at-least two primary ribs and at-least one secondary rib. The system further comprises a beam, a first set of sleeve anchors, a first set of bolts with washers, a first set of square hollow section boxes a second set of self tapping screws, a second set of sleeve anchors, a second set of bolts with washers, a second set of square hollow section boxes and a second set of self tapping screws.

According to one embodiment herein, the two primary ribs are adopted to be provided at the two opposite edges of the pre-cast concrete panel and the secondary rib is adopted to be provided at the center of the pre-cast concrete panel. The top portion of the pre-cast concrete panels is fixed to the beam and the beam comprises a plurality of holes for fixing the top portion of the pre-cast concrete panels. A first set of sleeve anchors is provided for fastening the top portion of the pre-cast concrete panels to the beam. The first set of sleeve anchors is inserted and fixed to the beam through the plurality of holes adopted on the beam and the first set of bolt with a washer. The first set of square hollow section boxes comprises pre-defined holes drilled at a bottom section and a top section, and wherein the first set of square hollow section boxes are fixed to the beam by inserting the first set of bolt with a washer into the top hole of the first set of the square hollow boxes, by aligning the top hole of the first set of the square hollow boxes with the first set of sleeve anchors and fixing the first set of bolt with a washer to the beam. A first set of self tapping screws are provided for fixing the top portion pre-cast concrete panels to the bottom sections of the first set of square hollow section boxes. The first set of self tapping screws are inserted into the bottom hole of the first set of square hollow section boxes for fixing the top portion of the pre-cast concrete panels to the bottom sections of the first set of square hollow section boxes. A bottom section of the pre-cast concrete panels is fixed to a floor slab by fastening the bottom portion of the pre-cast concrete panels to the beam using a second set of sleeve anchors, a second set of bolt with a washer, a second set of square hollow section boxes and a second set of self tapping screws.

According to an embodiment herein, the pre-cast concrete panels are arranged in a back to back fashion or manner to form a two piece wall. Further, an internal cavity partition is formed within the two piece wall and internal cavity partition comprises a predefined ducting in between the two piece wall.

According to an embodiment herein, the square hollow section boxes are tightly fixed to the beam by tightening the first set of bolts with the help of a drilling machine. The first set of sleeve anchors get embedded into the plurality of holes provided in the beam, when the first set of bolts are tightened.

According to an embodiment herein, the second set of sleeve anchors get embedded into the plurality of holes provided in the floor slab, when the second set of bolts are tightened.

According to an embodiment herein, the plurality of pre-cast wall panels are placed successively one after another, after the first set of square hollow section boxes and the second set of square hollow section boxes are fixed to the beam and the floor slab respectively.

According to an embodiment herein, the plurality of holes are made in conjunction with the square hollow section boxes on the pre-cast wall panels to anchor and secure the first pre-cast wall panel to the beam and the floor slab, when a first pre-cast wall panel is erected.

According to an embodiment herein, the system further comprises fibrous cement, and the fibrous cement of non shrink quality is applied on the edges of the plurality of pre-cast wall panels after anchoring the plurality of pre-cast wall panels to the beam and the floor slab. The fibrous cement is applied for filling a gap between the adjacent pre-cast wall panels.

According to an embodiment herein, the system further comprises one or more reinforced concrete cement (RCC) frames, and the or more reinforced concrete cement (RCC) frames are fixed at a location of a door. One or more dowel rods of pre-determined thickness are drilled at specified locations on the beam and the floor slab for fixing the one or more reinforced concrete cement (RCC) frames through the one or more dowel pins.

According to an embodiment herein, the system further comprises a mesh like structure arranged along an entire pre-cast concrete wall for providing stiffness and preventing a bending of the pre-cast concrete wall panels along a width direction.

According to an embodiment herein, reinforcement is provided for fabricating a non load bearing partition wall, and the reinforcement is selected from the group consisting of Fe415, a fiber reinforcement, a bamboo reinforcement, a paper reinforcement, a pre-tensioned wire rope reinforcement, and a post-tensioned wire rope reinforcement.

According to an embodiment herein, a method for fixing a load bearing partition wall with an internal cavity partition is provided. The method comprises the steps of studying layouts of the pre-cast wall panels as per the architectural drawings. The alignments of the pre-cast wall panels are marked on the floor slab. The alignments of the pre-cast wall panels are also provided at a bottom portion of beam. A verticality of a top mark and a bottom mark is checked. A plurality of holes is drilled into a top portion of the floor slab and at the bottom portion of beam by a pre-defined gig, when the verticality of the top mark and the bottom mark is judged successful and the top mark and the bottom mark are arranged on a vertical line. The pre-cast wall panels are anchored to the top portion of the floor slab and the bottom portion of the beam through one or more anchor bolts. A square hollow section box is tightly fixed along the pre-defined orientation, when the pre-cast wall panels are anchored. The plurality of pre-cast wall panels is placed one after another to form an internal cavity portion, when the square hollow section box is tightly fixed. A plurality of holes is drilled on the plurality of pre-cast wall panels in conjunction with the square hollow section box. A self tapping screw of a required length is screwed on to the square hollow section box to anchor the plurality of pre-cast wall panels. A first piece of the pre-cast wall panel is secured on the floor. A fibrous cement of non shrink quality or characteristics or property is applied along the edges of the pre-cast wall panel. A second pre-cast wall panel is jammed into a mortar of the fibrous cement. Wherein all the first pre-cast wall panels are secured by jamming the edges of all the first pre-cast wall panels. A plurality of service fixtures is installed within the internal cavity portion. A top portion and a bottom portion of the first pre-cast wall panels are sealed with a rich mix of water proof non-shrink fibrous cement. The edges of a second set of pre-cast wall panels are fixed with the edges on the first pre-cast wall panels to form an internal cavity portion within.

According to an embodiment herein, a pre-defined offset gap is provided between the edges of the first pre-cast wall panels and the edges of the second pre-cast wall panels to avoid a formation of through joints.

According to an embodiment herein, the step of anchoring the pre-cast concrete panels to the beam comprises the following steps of aligning a first pre-cast concrete panel with the beam. The first pre-cast concrete panel is anchored to the beam with the one or more anchor bolts. A plurality of service installations is fixed or arranged within the internal cavity portion. The internal cavity portion is a cavity formed between the first pre-cast concrete panel and the second pre-cast concrete panel. The second pre-cast concrete panel is aligned with the beam and anchored to the beam with the one or more anchor bolts.

According to an embodiment herein, the step of anchoring the pre-cast concrete panels to the floor slab comprises the following steps of aligning a first pre-cast concrete panel with the floor slab. The first pre-cast concrete panel is anchored to the floor slab with the one or more anchor bolts. A plurality of service installations is fixed or arranged within the internal cavity portion. A second pre-cast concrete panel is aligned with the floor slab and anchored to the floor slab with the one or more anchor bolts.

These and other aspects of the embodiments herein will be better appreciated and understood when considered in conjunction with the following description and the accompanying drawings. It should be understood, however, that the following descriptions, while indicating the preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1A:
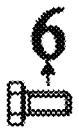
FIG. 1*a*-FIG. 1*e* illustrate accessories for fixing the pre-cast concrete panels (wall) to the beam and the floor slab, according to one embodiment herein.

Although specific features of the embodiments herein are shown in some drawings and not in others. This is done for convenience only as each feature may be combined with any or all of the other features in accordance with the embodiments herein.

DETAILED DESCRIPTION OF THE DRAWINGS

In the following detailed description, reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The embodiments herein provide a method and system for fabricating a non load bearing partition wall with an internal cavity portion with partitions. The system comprises at-least two pre-cast concrete panels and the two pre-cast concrete panels are arranged in back to back fashion. Each pre-cast concrete panel comprises a top portion, a bottom portion at-least two primary ribs and at-least one secondary rib. The system further comprises a beam, a first set of sleeve anchors, a first set of bolts with washers, a first set of square hollow section boxes a second set of self tapping screws, a second set of sleeve anchors, a second set of bolts with washers, a second set of square hollow section boxes and a second set of self tapping screws.

According to one embodiment herein, the two primary ribs are adopted to be provided at the two opposite edges of the pre-cast concrete panel and the secondary rib is adopted to be provided at the center of the pre-cast concrete panel. The top portion of the pre-cast concrete panels is fixed to the beam and the beam comprises a plurality of holes for fixing the top portion of the pre-cast concrete panels. A first set of sleeve anchors is provided for fastening the top portion of the pre-cast concrete panels to the beam. The first set of sleeve anchors is inserted and fixed to the beam through the plurality of holes adopted on the beam and the first set of bolt with a washer. The first set of square hollow section boxes comprises pre-defined holes drilled at a bottom section and a top section, and wherein the first set of square hollow section boxes are fixed to the beam by inserting the first set of bolt with a washer into the top hole of the first set of the square hollow boxes, by aligning the top hole of the first set of the square hollow boxes with the first set of sleeve anchors and fixing the first set of bolt with a washer to the beam. A first set of self tapping screws are provided for fixing the top portion pre-cast concrete panels to the bottom sections of the first set of square hollow section boxes. The first set of self tapping screws are inserted into the bottom hole of the first set of square hollow section boxes for fixing the top portion of the pre-cast concrete panels to the bottom sections of the first set of square hollow section boxes. A bottom section of the pre-cast concrete panels is fixed to a floor slab by fastening the bottom portion of the pre-cast concrete panels to the beam using a second set of sleeve anchors, a second set of bolt with a washer, a second set of square hollow section boxes and a second set of self tapping screws.

According to an embodiment herein, the pre-cast concrete panels are arranged in a back to back fashion or manner to form a two piece wall. Further, an internal cavity partition is formed within the two piece wall and internal cavity partition comprises a predefined ducting in between the two piece wall.

According to an embodiment herein, the square hollow section boxes are tightly fixed to the beam by tightening the first set of bolts with the help of a drilling machine. The first set of sleeve anchors get embedded into the plurality of holes provided in the beam, when the first set of bolts are tightened.

According to an embodiment herein, the second set of sleeve anchors get embedded into the plurality of holes provided in the floor slab, when the second set of bolts are tightened.

According to an embodiment herein, the plurality of pre-cast wall panels are placed successively one after another, after the first set of square hollow section boxes and the second set of square hollow section boxes are fixed to the beam and the floor slab respectively.

According to an embodiment herein, the plurality of holes are made in conjunction with the square hollow section boxes on the pre-cast wall panels to anchor and secure the first pre-cast wall panel to the beam and the floor slab, when a first pre-cast wall panel is erected.

According to an embodiment herein, the system further comprises fibrous cement, and the fibrous cement of non shrink quality is applied on the edges of the plurality of pre-cast wall panels after anchoring the plurality of pre-cast wall panels to the beam and the floor slab. The fibrous cement is applied for filling a gap between the adjacent pre-cast wall panels.

According to an embodiment herein, the system further comprises one or more reinforced concrete cement (RCC) frames, and the or more reinforced concrete cement (RCC) frames are fixed at a location of a door. One or more dowel rods of pre-determined thickness are drilled at specified locations on the beam and the floor slab for fixing the one or more reinforced concrete cement (RCC) frames through the one or more dowel pins.

According to an embodiment herein, the system further comprises a mesh like structure arranged along an entire pre-cast concrete wall for providing stiffness and preventing a bending of the pre-cast concrete wall panels along a width direction.

According to an embodiment herein, reinforcement is provided for fabricating a non load bearing partition wall, and the reinforcement is selected from the group consisting of Fe415, a fiber reinforcement, a bamboo reinforcement, a paper reinforcement, a pre-tensioned wire rope reinforcement, and a post-tensioned wire rope reinforcement.

According to an embodiment herein, a method for fixing a load bearing partition wall with an internal cavity partition is provided. The method comprises the steps of studying layouts of the pre-cast wall panels as per the architectural drawings. The alignments of the pre-cast wall panels are marked on the floor slab. The alignments of the pre-cast wall panels are also provided at a bottom portion of beam. A verticality of a top mark and a bottom mark is checked. A plurality of holes is drilled into a top portion of the floor slab and at the bottom portion of beam by a pre-defined gig, when the verticality of the top mark and the bottom mark is judged successful and the top mark and the bottom mark are arranged on a vertical line. The pre-cast wall panels are anchored to the top portion of the floor slab and the bottom portion of the beam through one or more anchor bolts. A square hollow section box is tightly fixed along the pre-defined orientation, when the pre-cast wall panels are anchored. The plurality of pre-cast wall panels is placed one after another to form an internal cavity portion, when the square hollow section box is tightly fixed. A plurality of holes is drilled on the plurality of pre-cast wall panels in conjunction with the square hollow section box. A self tapping screw of a required length is screwed on to the square hollow section box to anchor the plurality of pre-cast wall panels. A first piece of the pre-cast wall panel is secured on the floor. A fibrous cement of non shrink quality or characteristics or property is applied along the edges of the pre-cast wall panel. A second pre-cast wall panel is jammed into a mortar of the fibrous cement. Wherein all the first pre-cast wall panels are secured by jamming the edges of all the first pre-cast wall panels. A plurality of service fixtures is installed within the internal cavity portion. A top portion and a bottom portion of the first pre-cast wall panels are sealed with a rich mix of water proof non-shrink fibrous cement. The edges of a second set of pre-cast wall panels are fixed with the edges on the first pre-cast wall panels to form an internal cavity portion within.

According to an embodiment herein, a pre-defined offset gap is provided between the edges of the first pre-cast wall panels and the edges of the second pre-cast wall panels to avoid a formation of through joints.

According to an embodiment herein, the step of anchoring the pre-cast concrete panels to the beam comprises the following steps of aligning a first pre-cast concrete panel with the beam. The first pre-cast concrete panel is anchored to the beam with the one or more anchor bolts. A plurality of service installations is fixed or arranged within the internal cavity portion. The internal cavity portion is a cavity formed between the first pre-cast concrete panel and the second pre-cast concrete panel. The second pre-cast concrete panel is aligned with the beam and anchored to the beam with the one or more anchor bolts.

According to an embodiment herein, the step of anchoring the pre-cast concrete panels to the floor slab comprises the following steps of aligning a first pre-cast concrete panel with the floor slab. The first pre-cast concrete panel is anchored to the floor slab with the one or more anchor bolts. A plurality of service installations is fixed or arranged within the internal cavity portion. A second pre-cast concrete panel is aligned with the floor slab and anchored to the floor slab with the one or more anchor bolts.

The embodiments herein provide a method and system for fabricating a non load bearing partition wall with an internal cavity partition portions. According to one embodiment of the embodiments herein, a system is provided for fabricating a non load bearing partition wall with an internal cavity partition sections. The non load bearing partition wall comprises at-least two pre-cast concrete panels arranged in a back to back fashion. The pre-cast concrete panel comprises a plurality of ribs and the plurality of ribs enhances the stiffness matrix of the pre-cast concrete panel. At-least two ribs are adopted at the two opposite edges of the pre-cast concrete panel and at-least one rib is adopted at the center.

According to one embodiment herein, the spans between the pluralities of ribs are minimized for avoiding a bending of the pre-cast concrete panels along the width direction. The spacing of the ribs gives the stiffness required to the panel to prevent bending.

According to one embodiment herein, the face thickness of the non load bearing partition wall is at-least 25 mm. The ratio of the total width of the pre-cast concrete panel to an intermediate width is proportional to the depth (thickness) of the rib to the depth of the face thickness of the wall and also to the width of the rib. The shape and profile prevents the panel from bending along the width.

According to one embodiment herein, the entire pre-cast concrete panel along the width is considered or formed as a monolithic panel based on the profile shape in the pre-cast concrete panel. This monolithic shape or behavior enhances the moment of inertia of the precast element or panel.

According to one embodiment herein, the pluralities of ribs are adopted along the lateral or transverse axis (at right angle or in an inclined direction or straight angle) for achieving the monolithic behavior or shape. The monolithic behavior enhances the moment of inertia of the precast element or panel.

According to one embodiment herein, the non load bearing partition wall comprises at-least two pre-cast concrete panels arranged in a back to back fashion or manner to form a two piece wall. The two piece wall comprises a predefined duct formed in between the two walls and the duct helps in fixing or installing the fixtures for the required services like plumbing pipes or electrical pipes.

According to one embodiment herein, the light weight concrete with density between 800-1000 kgs and concrete grades from M7.5 to M200 are used in fabricating the pre-cast concrete panels to form the non load bearing partition wall.

According to one embodiment herein, the properties of concrete are altered by adding admixtures, chemicals, cementation materials, earth, polymer materials, a replacement to cement or any other material to produce the same desired effect.

According to one embodiment herein, reinforcement is provided for fabricating the non load bearing partition wall. The reinforcement is selected from the group consisting of a Fe415 material or any other reinforcement mentioned in IS codes, Fiber reinforcement material, a Bamboo reinforcement material, a Paper reinforcement material, Wire rope (Pre tensioned or post tensioned) and any type of reinforcement (any suitable material) based on the design criteria.

According to one embodiment herein, a mesh like structure is adopted along the entire precast concrete wall to enhance the stiffness and preventing the panel from bending along the width direction.

According to one embodiment herein, the non load bearing partition wall is used for the weight roofing systems, by providing an under support for the roof with the pre-cast concrete wall panel along the horizontal direction.

According to one embodiment herein, these pre-cast concrete walls are used as permanent integral structural formwork or framework with additional concrete by using the concept of friction bonding by leaving shear connectors in any manner. These behaviors of friction bonding take the total thickness of the slab including the pre-cast concrete wall thickness into design criteria. Depending on the span, the thickness of the pre-cast member are varied and under supported temporarily during a pouring of concrete.

According to one embodiment herein, the shear connectors are fixed to wall panel on two sides as formwork for vertical member, i.e. two faces of the pre-cast concrete walls are inter connected in vertical and horizontal by shear connectors with a cavity in between the two faces.

According to one embodiment herein, the pre-cast concrete panels are lifted and placed on the beam and anchored to the surface with the help of one or more anchor bolts. Since the panels are larger when compared to the masonry, and the fixing process is easier and is dry fixed; the productivity is larger. It does not involve cement mortar and curing. A predefined gap is adopted or provided between the beam and the pre-cast wall panel to prevent a deflection being transferred to the members.

According to one embodiment herein, the service installations are fixed within the cavity portion and is adopted for providing easy routing of services which are intend to be provided within the pre-cast concrete wall. The services comprise electrical wiring, conducting, switch box fixing etc. needed in a construction industry; plumbing systems which are required in a construction industry; thermal insulation; door frame and window frame fixing; etc., and any other services and fixtures, and finishes which are liable to be incorporated in a construction industry.

According to one embodiment herein, the nature of the pre-cast concrete panel moulds used is also varied and the materials of the mould are also varied with respect to the required finishing quality.

According to one embodiment herein, the non load bearing partition wall with an internal cavity partition portion is used as compound walls, peripheral enclosure and all types of walls.

Figure 1B:
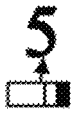
Figure 1C:
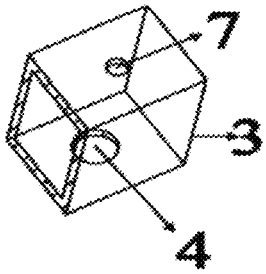
Figure 1D:
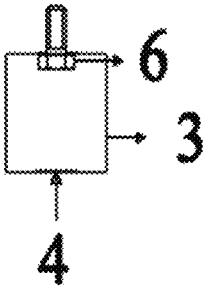
Figure 1E:
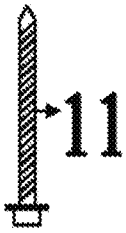

FIG. 1*a*-FIG. 1*e* illustrates the perspective views of accessories or components used for fixing the pre-cast concrete panels (wall) to the beam and the floor slab, according to one embodiment herein. The accessories for fixing the pre-cast concrete panels to the beam and the floor slab comprises a bolt 6 (preferably M12 Bolt with washer) as shown in FIG. 1*a*, a set of sleeve anchors 5 for fastening the top portion of the pre-cast concrete panels to the beam, as shown in FIG. 1*b* and wherein the set of sleeve anchors 5 are inserted and fixed to the beam through the plurality of holes adopted on the beam, a set of square hollow section boxes 3 (preferably of 3.2 mm thick) as shown in FIG. 1*c* and FIG. 1*d* and a set of self tapping screws 11 for fixing the pre-cast concrete panels to the set of square hollow section boxes 3 (preferably of 75 mm long) as shown in FIG. 1*e*. The bolt 6 is fixed to the top hole in the square hollow section (SHS) box 3. The tightening of the bolt 6 is done by using a drilling machine from the bottom 4 of SHS box 3. The SHS box 3 comprises predefined holes drilled at the bottom 4 and top 7 as shown in FIG. 1*c*.

According to one embodiment herein, the square hollow section boxes 3 comprise pre-defined holes drilled at a bottom section and a top section. The first set of square hollow section boxes 3 are fixed to the beam by inserting the first set of bolt 6 with a washer into the top hole 7 of the first set of the square hollow boxes 3. The top hole 7 of the first set of the square hollow boxes 3 is aligned with the first set of sleeve anchors 11 and the first set of bolt 6 with a washer is fixed to the beam 1. Similarly, the second set of square hollow section boxes 3 are fixed to the floor slab by inserting the second set of bolt 6 with a washer into the top hole 7 of the second set of the square hollow boxes 3. The top hole 7 of the second set of the square hollow boxes 3 is aligned with the second set of sleeve anchors 11 and the second set of bolt 6 with a washer is fixed to the floor slab.

According to one embodiment herein, the first set of self tapping screws 11 are adopted for fixing the top portion of the pre-cast concrete panels to the bottom sections of the first set of square hollow section boxes. The first set of self tapping screws are inserted into the bottom hole of the first set of square hollow section boxes for fixing the top portion of the pre-cast concrete panels to the bottom sections of the first set of square hollow section boxes. Similarly, the second set of self tapping screws 11 are adopted for fixing the bottom portion of the pre-cast concrete panels to the bottom sections of the second set of square hollow section boxes.

According to one embodiment herein, the square hollow section boxes 3 are tightly fixed to the beam and the floor slab by tightening the set of bolts 6 with the help of a drilling machine. The set of sleeve anchors 5 get embedded into the plurality of holes provided in the beam and the floor slab, when the set of bolts 6 are tightened.

Figure 2:
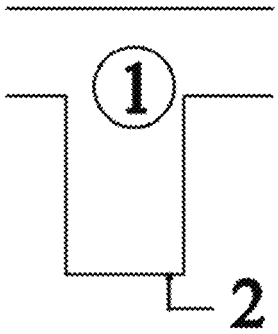
FIG. 2 illustrates a cross sectional view of the beam, according to one embodiment herein.

FIG. 2 illustrates a cross sectional view of the beam, according to one embodiment herein. The beam 1 comprises a plurality of holes 2 as shown in FIG. 2 for inserting the sleeve anchor to fix the top portion of the pre-cast concrete panels to the beam 1.

Figure 3:
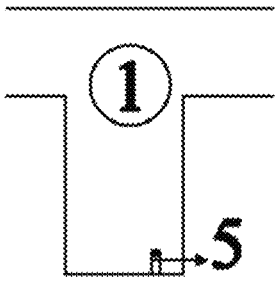
FIG. 3 illustrates a cross sectional view of the beam indicating a sleeve anchor, according to one embodiment herein.

FIG. 3 illustrates a cross sectional view of the beam indicating a sleeve anchor, according to one embodiment herein. The sleeve anchors 5 are inserted and fixed to the beam 1 as shown in FIG. 3 through the plurality of holes drilled at the required location.

Figure 4:
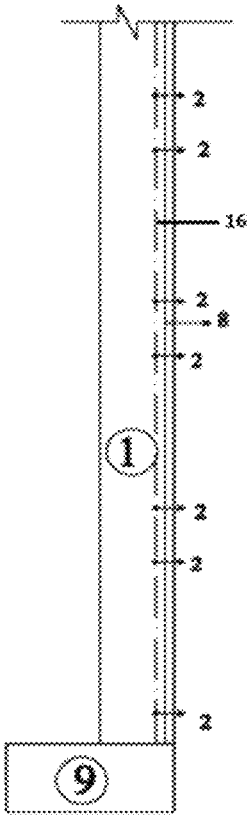
FIG. 4 illustrates a bottom view of the beam indicating a drilling hole for fixing pre-cast concrete wall to the beam, according to one embodiment herein.

FIG. 4 illustrates s a bottom side view of the beam indicating a method of drilling hole for fixing the pre-cast concrete wall to the beam, according to one embodiment herein. The inner line 8 of the pre-cast wall panel is fixed to the beam 1. The thickness of the inner line/face is preferably of 25 mm. A marking (for drilling hole) is done at a distance of preferably of 25 mm from the edge of beam 1 with the help of marking thread dipped in ink. The SHS box is preferably of 50*50*3.2 mm thick. Another marking of 25 mm is done from the inner line 8 as shown in FIG. 4. This line 16 is along which the drilling of holes 2 has got to be done. First marking for drilling hole 2 is done form the column 9. A gap preferably of 85 mm is left from the column face as shown in FIG. 4. A hole 2 is drilled along this marked point. The next point is marked and drilled hole 2 from 440 mm from the first marked point. The third point/hole 2 is drilled at a distance of 80 mm from the second point as shown in FIG. 4. The procedure is repeated taking the same distance between the first and second points and between second and third and continued till the desired last point is reached.

Figure 5:
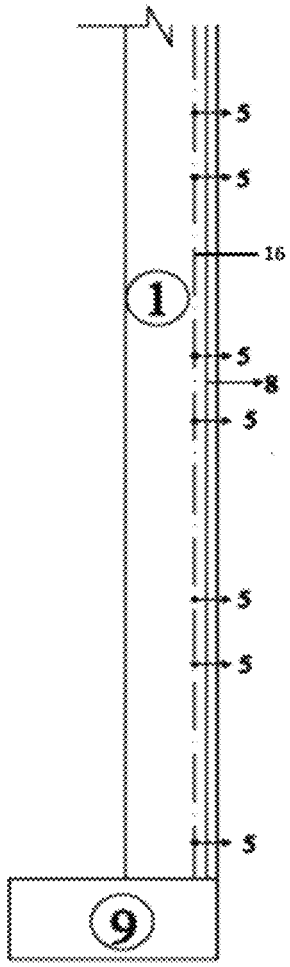
FIG. 5 illustrates a bottom view of the beam indicating a fixing of a sleeve anchor, according to one embodiment herein.

FIG. 5 illustrates a bottom view of the beam indicating a sleeve anchor, according to one embodiment herein. The sleeve anchors 5 are fixed along the holes 2 drilled as shown in FIG. 5.

Figure 6:
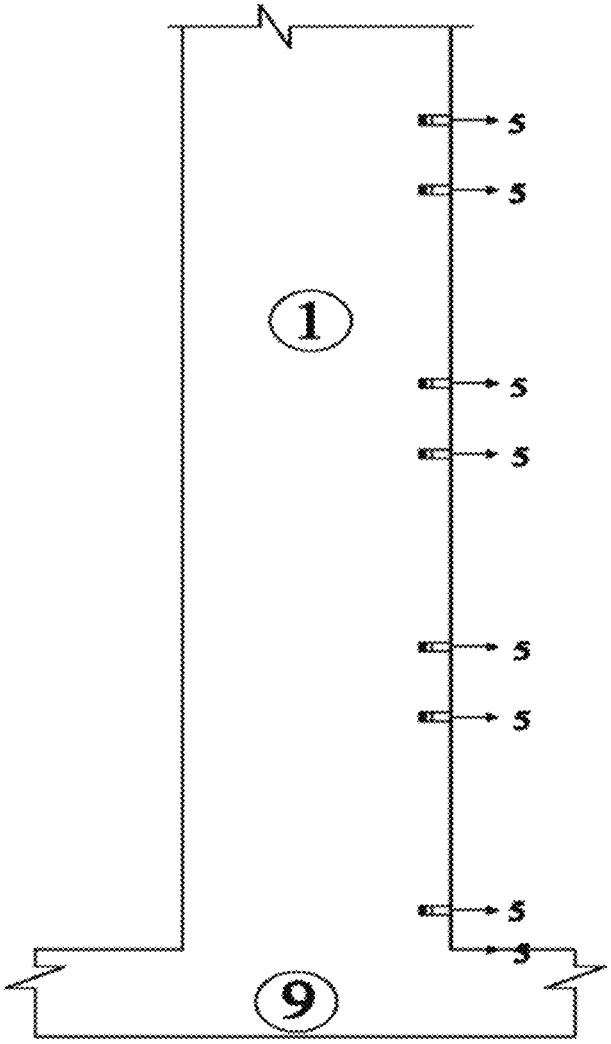
FIG. 6 illustrates a longitudinal view of the beam indicating a fixing of a sleeve anchor, according to one embodiment herein.

FIG. 6 illustrates a longitudinal view of the beam indicating a sleeve anchor, according to one embodiment herein. The sleeve anchors 5 are fixed along the holes 2 drilled as shown in FIG. 6.

Figure 7:
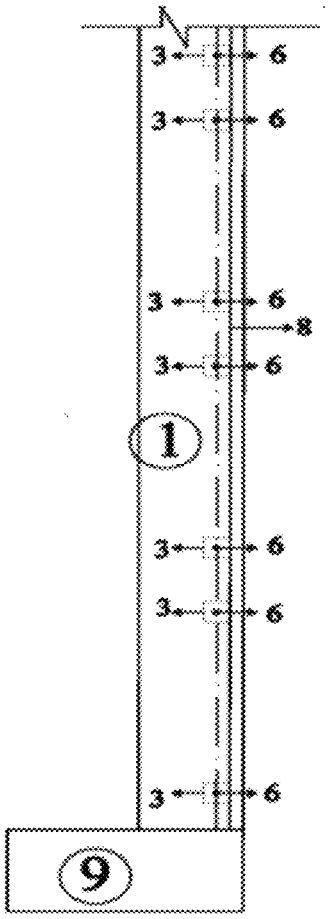
FIG. 7 illustrates a bottom view of the beam indicating a fixing of a square hollow section (SHS) box, according to one embodiment herein.

FIG. 7 illustrates a bottom view of the beam indicating the fixing of square hollow section (SHS) boxes, according to one embodiment herein. The SHS box 3 (preferably of 50*50*3.2 mm) comprises predefined holes drilled at the bottom 4 (bottom hole) and top 7 (top hole). The bottom hole 4 has a preferred diameter of 20 mm and the top hole 7 is used for inserting M10/M12 bolt 6 with the washer. The top hole 7 of the SHS box 3 is aligned with the sleeve anchor 5 fixed to the beam bottom 1 or the floor slab. Then the bolt 6 with washer is fixed through the box 3 to the sleeve anchor 5. With the help of a drilling machine, the bolt 6 is tightened from the bottom hole 4 of SHS box 3. The SHS box 3 gets tightly fixed to the beam 1 or the floor slab. As the bolt 6 gets tightened, the sleeve anchors 5 get embedded into the beam 1. Similarly the SHS boxes 3 are fixed to the floor slab, aligned with respect to the top box sections 3.

Figure 8:
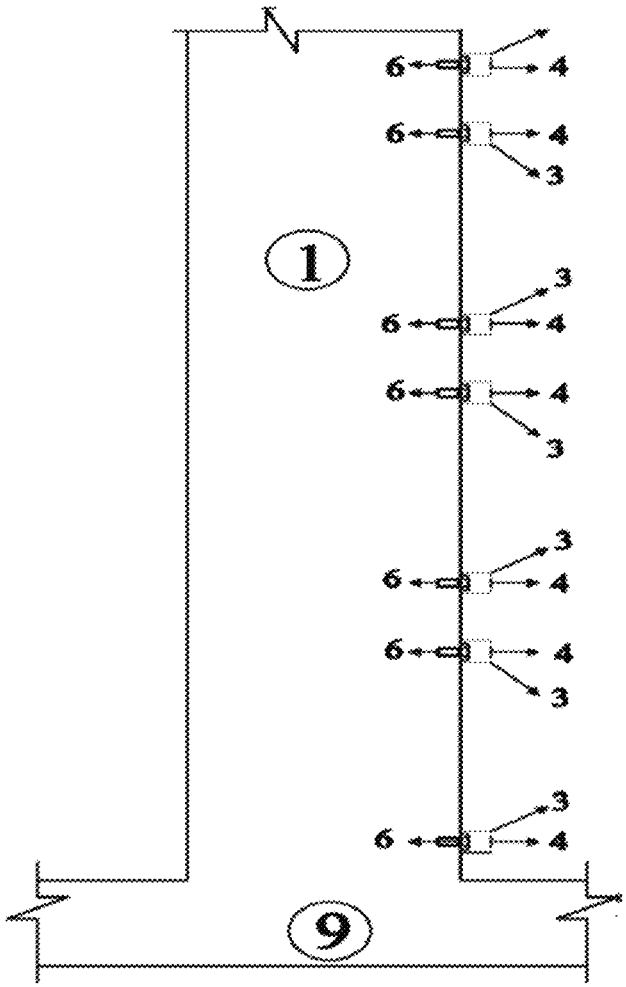
FIG. 8 illustrates a longitudinal view of the beam indicating a fixing of a square hollow section (SHS) box, according to one embodiment herein.

FIG. 8 illustrates a longitudinal view of the beam indicating the fixing of square hollow section (SHS) box, according to one embodiment herein. The top hole 7 of the SHS box 3 is aligned with the sleeve anchor 5 fixed to the beam bottom or slab bottom 1. Then the bolt 6 with washer is fixed through the box 3 to the sleeve anchor 5. With the help of a drilling machine, the bolt 6 is tightened from the bottom hole 4 of SHS box 3. Similarly the SHS boxes 3 are fixed to the floor slab, aligned with respect to the top box sections 3.

Figure 9:
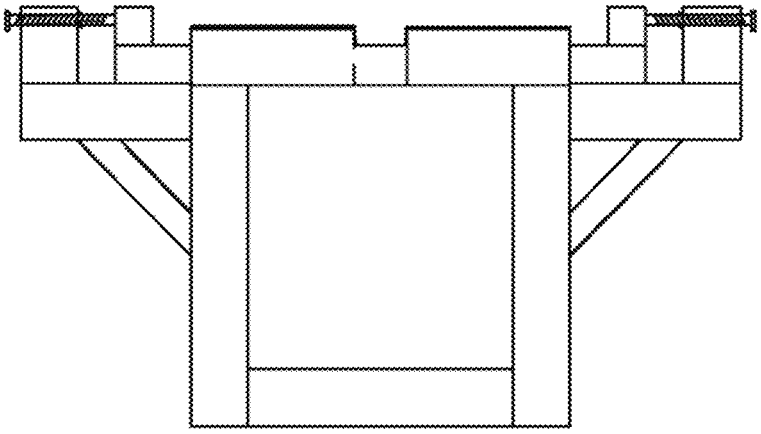
FIG. 9 illustrates a cross sectional view of the pre-cast concrete wall mould, according to one embodiment herein.

FIG. 9 illustrates a cross section view of the pre-cast concrete wall mould, according to one embodiment herein. The mould for casting/fabricating the pre-cast concrete wall panels 14 is an adjustable mould in which the pieces with length ranging from 0.9 to 3.0 m are casted. The width of the moulded piece is 600 mm. The size of the pre-cast concrete wall panel is 600*length. The pre-cast concrete panels are arranged in the back to back fashion or manner to form a two piece wall. An internal cavity partition is formed within the two piece wall, and the internal cavity partition comprises a predefined duct in between the two piece wall.

Figure 10:
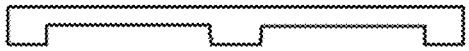
FIG. 10 illustrates a cross sectional view of the pre-cast concrete wall panel (non load bearing partition wall), according to one embodiment herein.

FIG. 10 illustrates a cross section view of the pre-cast concrete wall panel (non load bearing partition wall), according to one embodiment herein. The casted concrete wall panel 14 is as shown in FIG. 10.

Figure 11:
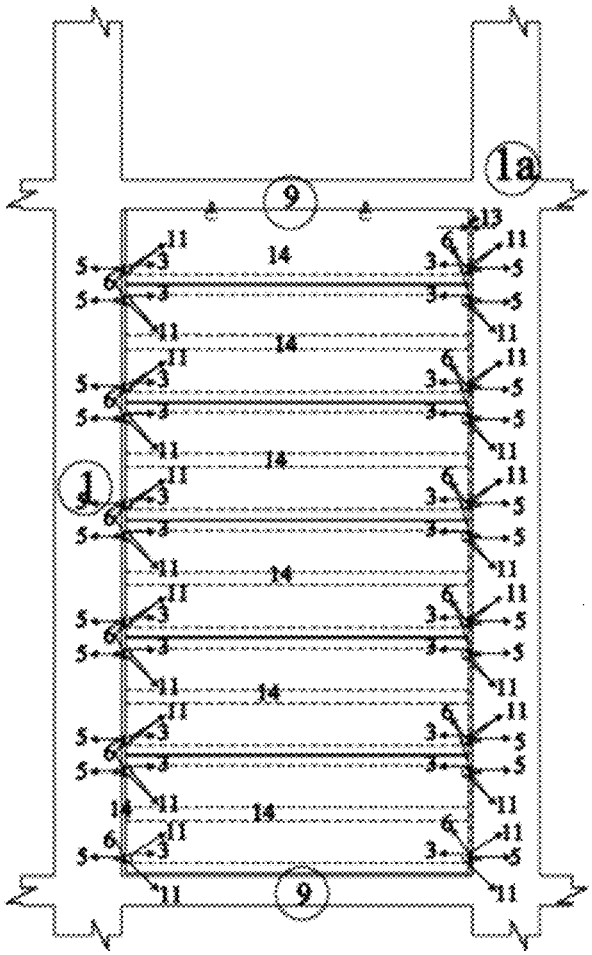
FIG. 11 illustrates a front view of one face of the pre-cast concrete wall fixed to the beam, according to one embodiment herein.

FIG. 11 illustrates a front view of one face of the pre-cast concrete wall fixed to the beam, according to one embodiment herein. After the SHS boxes 3 are fixed, the pre-cast wall panels 14 are placed one after the other or one by one. Once the first panel is erected 14, and is placed in position, based on the design, the holes 2 are made in conjunction with the SHS boxes 3, to anchor the panel 14. After the two holes 2 are drilled, a 5 mm self tapping screw 1 of required length is screwed on to both the top 7 and bottom 4 portions of the SHS box 3. Then the first piece of the pre-cast wall panel 14 is secured. A fibrous cement of non shrink quality of minimum thickness 5-10 mm is applied along the edges of the panel 14. A sufficient gap 13 is provided between the pre-cast concrete panels and the beam 1 as shown in FIG. 11.

According to one embodiment herein, the plurality of holes are made in conjunction with the square hollow section boxes on the pre-cast wall panels, to anchor and secure the first pre-cast wall panel to the beam and the floor slab, when a first pre-cast wall panel is erected.

According to one embodiment herein, the plurality of pre-cast wall panels are placed successively one after another, after the first set of square hollow section boxes and the second set of square hollow section boxes are fixed to the beam and the floor slab respectively.

According to one embodiment herein, the fibrous cement of non shrink quality is applied on the edges of the plurality of pre-cast wall panels after anchoring the plurality of pre-cast wall panels to the beam and the floor slab. Further, the fibrous cement is applied for filling the gap between the adjacent pre-cast wall panels.

Figure 12A:
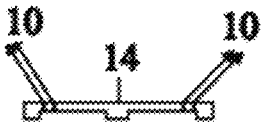
FIG. 12*a* illustrates a cross sectional view of the pre-cast concrete wall panel with predefined holes, according to one embodiment herein.

FIG. 12*a* illustrates a cross section view of the pre-cast concrete wall panel with predefined holes, according to one embodiment herein. The pre-cast concrete wall panel 14 comprises the plurality of pre-defined holes 10 left during casting of the precast wall panels 14 as shown in FIG. 12*a*. The plurality of pre-defined holes 10 are left for fixing the wall panels 14 to the SHS box section 3.

Figure 12B:
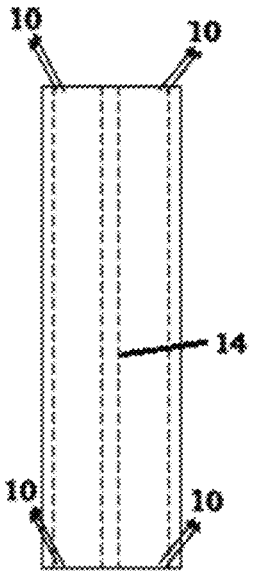
FIG. 12*b* illustrates a front view of the pre-cast concrete wall panel with predefined holes, according to one embodiment herein.

FIG. 12*b* illustrates a front view of the pre-cast concrete wall panel with predefined holes, according to one embodiment herein. The pre-cast concrete wall panel 14 comprises the plurality of pre-defined holes 10 left during the casting of the precast wall panels 14 as shown in FIG. 12*b*. The plurality of pre-defined holes 10 are left for fixing the wall panels 14 to the SHS box section 3.

Figure 12C:
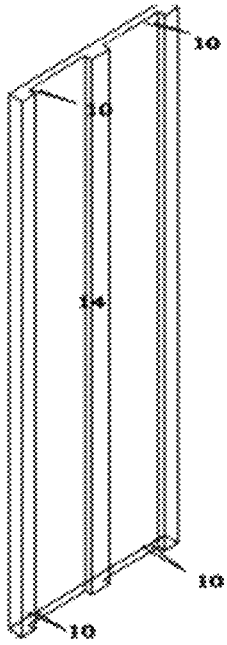
FIG. 12*c* illustrates a perspective view of the pre-cast concrete wall panel with predefined holes, according to one embodiment herein.

FIG. 12*c* illustrates a perspective view of the pre-cast concrete wall panel with predefined holes, according to one embodiment herein. The pre-cast concrete wall panel 14 comprises the plurality of pre-defined holes 10 left during the casting of the precast wall panels 14 as shown in FIG. 12*c*.

The plurality of pre-defined holes 10 are left for fixing the wall panels 14 to the SHS box section 3.

Figure 13:
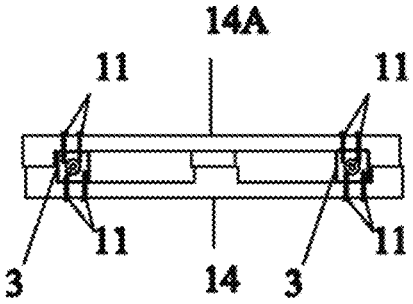
FIG. 13 illustrates a cross sectional view of the pre-cast concrete wall indicating a cavity between the pre-cast concrete wall panels, according to one embodiment herein.

FIG. 13 illustrates a cross sectional view of the pre-cast concrete wall with a cavity in between, according to one embodiment herein. The SHS box sections 3 are fixed to the beam bottom 1 portion and the slab top 1*a* portion. The precast wall 14 panels are just placed along these SHS box sections 3. The verticality of the precast wall are checked and they are screwed into the SHS box sections 3 with the help of self tapping screw 11, inserted into the through hole 10. The precast wall 14 is fixed to the box section 3 with the help of self tapping screws 11. The first pre-cast wall panel 14 is fixed. After leaving a gap of 5 mm between the first and second panel and the procedure is repeated. There is a 5-10 mm gap at the top of the pre-cast wall panel 14 and the beam bottom 1. When the last panel 14 on the first face is to be erected, the dimensions are taken and the panel 14 is cut to size. The SHS box sections 3 are fixed to the column 9 (following the same procedure as fixing to beam bottom 1). The holes are drilled wherever required to fix the pre-cast wall panel 14 to the SHS box section 3. The pre-cast wall panel is fixed to the SHS box section 3 Using self tapping screws 11. Two self tapping screws 11 are used per SHS box section 3 for fastening to the pre-cast wall panel.

Figure 14:
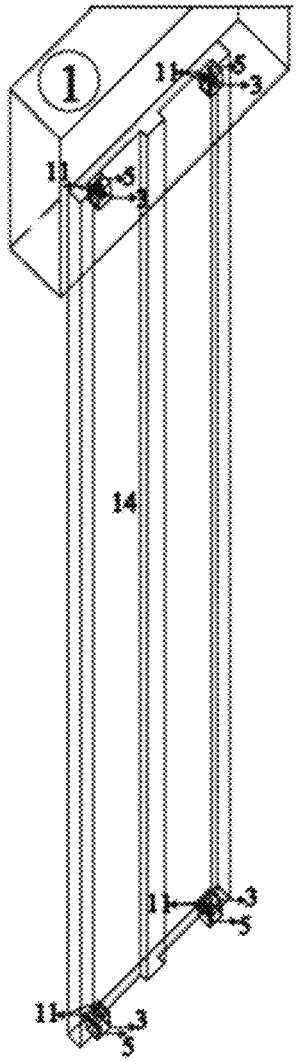
FIG. 14 illustrates a perspective view of the single face of pre-cast concrete wall fixed to beam bottom, according to one embodiment herein.

FIG. 14 illustrates a perspective view of the single face of pre-cast concrete wall fixed to beam bottom, according to one embodiment herein. The pre-cast wall panel 14 is fixed to the beam bottom 1 using the SHS box section 3, which is anchored to the beam bottom 1 using sleeve anchor 5 and M12 bolt 6 with the washer.

Figure 15:
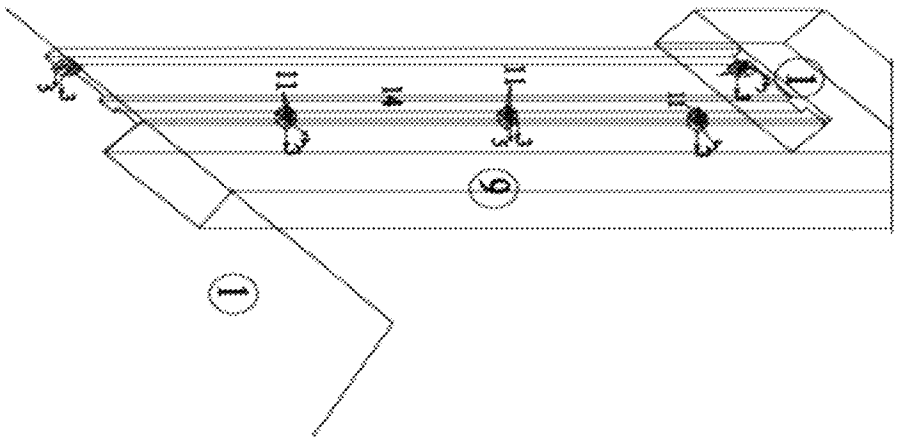
FIG. 15 illustrates a perspective view of the pre-cast concrete wall cut and fixed to column front, according to one embodiment herein.

FIG. 15 illustrates a perspective view of the pre-cast concrete wall cut and fixed to column front, according to one embodiment herein. The ends of the pre-cast wall panel 14 is cut to size near the column 9 and the pre-cast wall panel 14 is fixed to the beam bottom 1 using the SHS box section 3. The SHS box section 3 is anchored to the beam bottom 1 using the sleeve anchor 5 and M12 bolt 6 with the washer.

Figure 16:
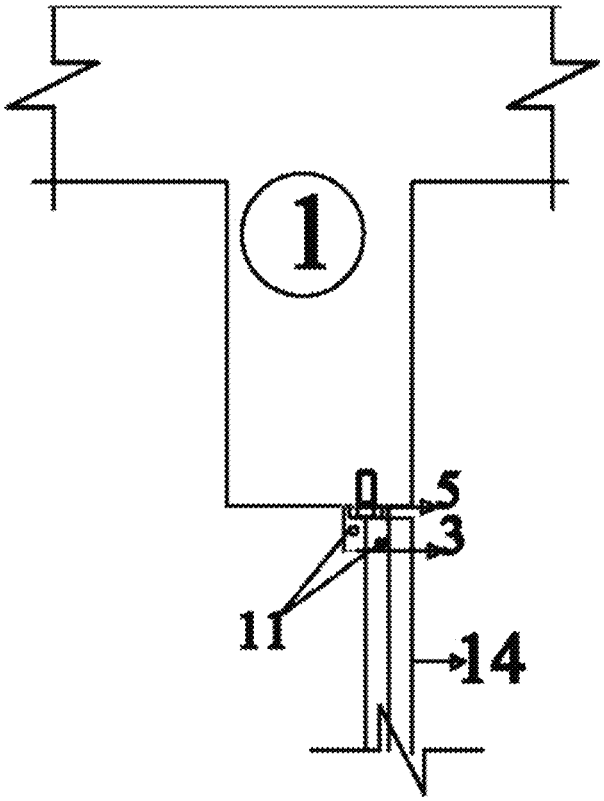
FIG. 16 illustrates a bottom view of beam indicating a fixing of pre-cast concrete wall, according to one embodiment herein.

FIG. 16 illustrates a bottom view of beam indicating a fixing of the pre-cast concrete wall, according to one embodiment herein. The pre-cast wall panel 14 is fixed to the beam bottom 1 using the SHS box section 3 and the SHS box section 3 is anchored to the beam bottom 1 using the sleeve anchor 5 and M12 bolt 6 with the washer. There is a gap between precast wall panel 14 and beam bottom 1 as shown in FIG. 16. The gap should be between 5 to 10 mm.

Figure 17:
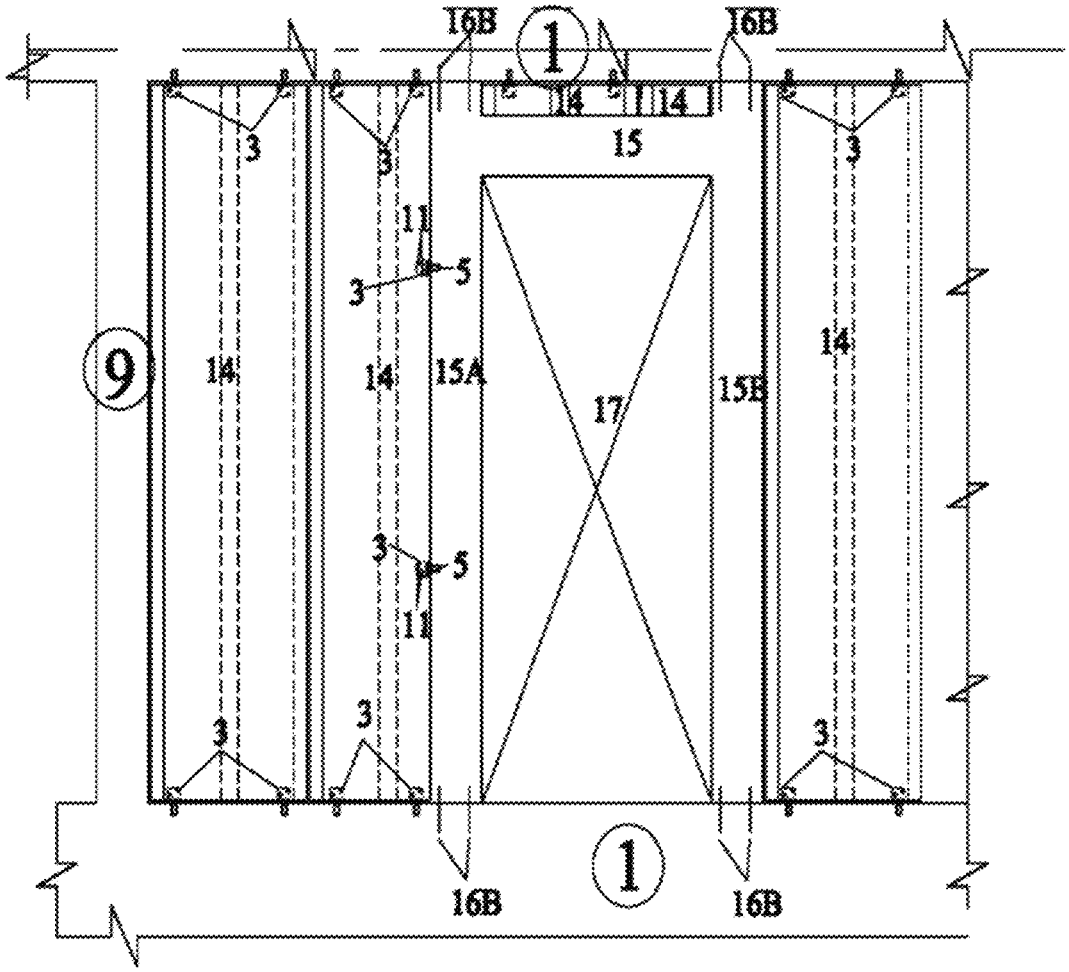
FIG. 17 illustrates a front view of the door opening and precast wall, according to one embodiment herein.

FIG. 17 illustrates a front view of the door opening and precast wall, according to one embodiment herein. At the location of door 17 opening, the Reinforced Concrete Cement (RCC) frames 15, 15A, 15B are fixed as shown in FIG. 17. One or more dowel rods of 12 mm diameter 16B are drilled at the required locations on the beam 1 and slab 1*a* to fix the RCC frames 15, 15A, 15B. The pre-cast RCC members 15, 15A, 15B are then fixed to these dowel pins 16B. The pre-cast wall panels 14 are then fixed. The door 17 frames are fixed to the new RCC frame 15, 15A, 15B by regular practice.

According to one embodiment herein, one face of the pre-cast wall panel (first pre-cast wall panel) 14 work is completed once; the electrical, mechanical and other services are placed between the vertical columns (cavity) in the pre-cast wall panels 14. The services are fixed to the wall panel by any method found feasible. Then the second face of the pre-cast wall panel (second pre-cast wall panel) 14A is fixed to the beam 1. The first pre-cast wall panel 14A on the rear side comprises a 5-10 mm gap from the edge of the first pre-cast wall panel 14 when erected as shown in FIG. 13.

According to one embodiment herein, the gap between the pre-cast walls 14/14A and beam bottom 1 are packed with a weak mortar or with sodium silicate and fly ash or any other weak material in use. The joints between the pre-cast wall panels (first pre-cast wall panel and second pre-cast wall panel) are packed with a weak mortar. The joints of the pre-cast wall panels are then taped with a fabric net or any other net to prevent the joint from cracking. A 3-5 mm patty is adopted over the pre-cast wall panels.

According to one embodiment herein, the plurality of pre-defined holes is provided in the pre-cast wall panel and this avoids unwanted groove gutting and chipping. Since the panels are pre-cast, it totally avoids curing at site, thereby making the site free form water logging. Furthermore, the panels are pre-cast and the window frame and doors frames can be monolithically fixed into the panel or can be fixed with any feasible manner thereby avoiding the cracks which may appear at the joints of door frame and masonry junction. Once the panel cavity wall is erected, the other activities are started immediately thereby eliminating a time loss in curing.

According to one embodiment herein, the method for fixing non load bearing partition wall to the beam comprises the steps of studying the layouts of the pre-cast wall panels as per the architectural drawings, marking the alignments of the walls on the floor and transferring the same to the soffit (beam bottom) of beam or slab and checking the verticality of the top and the bottom mark. Once both the markings are found in line, a pre-defined gig is used to drill the holes into the slab top portion and the beam bottom portion or slab bottom portion. Then the same are fixed in the required place with the help of anchor bolts, based on a design plan. Once the anchor bolts are provided in the correct location and positioned, a SHS (square hollow section) is tightly fixed along the required orientation. After the SHS are fixed, the pre-cast wall panels are placed one after the other or one by one in a back to back fashion or manner. Once the first panel is erected and is positioned, the holes are made in conjunction with the SHS to anchor the panel, based on the design plan. After the two holes are drilled, a 5 mm self tapping screw of required length is screwed on to both the top and bottom portions of the SHS. Then the first piece of the pre-cast wall panel is secured. Along the edges of the panel, fibrous cement past of non shrink quality of minimum thickness 5-10 mm is applied. Then the second panel is jammed into the mortar. The same procedure is followed till all the panels (first pre-cast wall panel) are fixed in one face. Care is taken to avoid any drilling or chipping of the panels once they are fixed in place. The next step is to incorporate required the services fixtures in the cavity of the panel. After the installation of the services fixtures, the top and bottom of one panel (i.e. first pre-cast wall panel) is sealed with water proof non shrink fibrous cement rich mix. Further, a 10 mm offset gap is left between the two successive panels with respect to the first edge, to avoid through joints while installing the second panel (second or back pre-cast wall panel). The same procedure is followed till all the panels (second or back pre-cast wall panel) are fixed in one face According to one embodiment herein, the usage of admixtures, fly ash, clinkers, polystyrene and other materials reduces the weight of the pre-cast wall panel. Depending on the location, the design requirements can be altered.

The slenderness of the invention helps in reducing the weight compared to regular wall thickness of 100-200 mm.

The wall panels are caste on site or in the factory, before the actual requirement of the panel is required. When the panel gains sufficient strength, the panels are shifted to the required location. They are just fixed in position. These are pre-engineered pre-cast wall panels which are ready to use.

As of today, the buildings are bigger and more advanced in quality, the cavity wall is more economical and lighter when compared to the masonry wall.

The pre-cast cavity walls have a higher degree of quality and precession as it is manufactured in a controlled environment.

It is also very easy to erect the walls, using only the nuts and bolts, thereby increasing the productivity of construction.

The idea of walling panel, which has a cavity, and uses the concept of monolithic property to prevent bending along the width and length, with a special method of anchorage, the panels have a inbuilt duct facility which enable services to be added through it and also allows for modifications to be made after installation of the wall which may be finished by cement past over a mesh structure.

The foregoing description of the specific embodiments herein will so fully reveal the general nature of the embodiments herein that others can, by applying current knowledge, readily modify and/or adapt for various applications such specific embodiments herein without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the embodiments herein with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A system for fabricating a non load bearing partition wall with an internal cavity having partition, the system comprises:

at-least two pre-cast concrete panels, and wherein the two pre-cast concrete panels are arranged in a back to back fashion, and wherein each pre-cast concrete panel comprises a top portion and a bottom portion;

at-least two primary ribs, and wherein the two primary ribs are adopted to be provided at two opposite edges of the pre-cast concrete panel;

at-least one secondary rib, and wherein the secondary rib is adopted to be provided at a center of the pre-cast concrete panel;

a beam, and wherein the beam comprises a plurality of holes for fixing the top portion of the pre-cast concrete panels, and wherein the top portion of the pre-cast concrete panels are fixed to the beam;

a first set of sleeve anchors for fastening the top portion of the pre-cast concrete panels to the beam, and wherein the first set of sleeve anchors are inserted and fixed to the beam through the plurality of beam holes;

a first set of bolts with washers;

a first set of square hollow section boxes, and wherein the first set of square hollow section boxes comprises a plurality of pre-defined holes drilled at a bottom section and a top section, and wherein the first set of square hollow section boxes are fixed to the beam by inserting the first set of bolt with a washer into the top hole of the first set of the square hollow boxes, aligning the top hole of the first set of the square hollow boxes with the first set of sleeve anchors and fixing the first set of bolts with washers to the beam; and a first set of self tapping screws for fixing the top portion of the pre-cast concrete panels to the bottom section of the first set of square hollow section boxes, and wherein the first set of self tapping screws are inserted into the bottom hole of the first set of square hollow section boxes for fixing the top portion of the pre-cast concrete panels to the bottom section of the first set of square hollow section boxes;

wherein a bottom section of the pre-cast concrete panels are fixed to a floor slab by fastening the bottom portion of the pre-cast concrete panels to the beam using a second set of sleeve anchors, a second set of bolts with washers, a second set of square hollow section boxes and a second set of self tapping screws.

2. The system according to claim 1, wherein the pre-cast concrete panels are arranged in the back to back fashion to form a two piece wall, and wherein an internal cavity with partitions is formed within the two piece wall, and wherein the internal cavity with partition comprises a predefined duct formed between the two piece walls.

3. The system according to claim 1, wherein the square hollow section boxes are tightly fixed to the beam by tightening the first set of bolts with the help of a drilling machine, and wherein the first set of sleeve anchors are embedded into the plurality of beam holes, when the first set of bolts are tightened.

4. The system according to claim 1, wherein the second set of sleeve anchors are embedded into the plurality of holes provided in the floor slab, when the second set of bolts are tightened.

5. The system according to claim 1, wherein the plurality of pre-cast wall panels are placed successively one after another, after the first set of square hollow section boxes and the second set of square hollow section boxes are fixed to the beam and the floor slab respectively.

6. The system according to claim 1, wherein plurality of holes are made in conjunction with the square hollow section boxes on the pre-cast wall panels, when a first pre-cast wall panel is erected to anchor and secure the first pre-cast wall panel to the beam and the floor slab.

7. The system according to claim 1 further comprises a fibrous cement, and wherein the fibrous cement of non shrink quality is applied on the edges of the plurality of pre-cast wall panels after anchoring the plurality of pre-cast wall panels to the beam and the floor slab, and wherein the fibrous cement is applied for filling the gap between the adjacent pre-cast wall panels.

8. The system according to claim 1 further comprises one or more reinforced concrete cement (RCC) frames, and wherein one or more reinforced concrete cement (RCC) frames are fixed at a location of a door, and wherein one or more dowel rods of pre-determined thickness are drilled at specified locations on the beam and the floor slab for fixing one or more reinforced concrete cement (RCC) frames through one or more dowel pins.

9. The system according to claim 1 further comprises a mesh like structure arranged along the entire pre-cast concrete wall for providing stiffness and preventing a bending of the pre-cast concrete wall panels along a width direction.

10. The system according to claim 1, wherein a reinforcement is provided for fabricating a non load bearing partition wall, and wherein the reinforcement is selected from the group consisting a Fe415, a fiber reinforcement, a bamboo reinforcement, a paper reinforcement, a pre-tensioned wire rope reinforcement, and a post-tensioned wire rope reinforcement.

11. A method for fixing a load bearing partition wall with an internal cavity partition, the method comprises steps of:

studying layouts of the pre-cast wall panels as per the architectural drawings;

marking alignments of the pre-cast wall panels on the floor slab;

transferring the alignments to a bottom portion of a beam;

checking a verticality of a top mark and a bottom mark;

drilling holes into a top portion of the floor slab and at the bottom portion of the beam by a pre-defined gig, when the vertical alignment of the top mark and the bottom mark is verified and the top mark and the bottom mark are arranged on a vertical line;

anchoring the pre-cast wall panels to the top portion of the floor slab and the bottom portion of the beam bottom through one or more anchor bolts;

fixing a square hollow section box tightly along the pre-defined orientation when the pre-cast wall panels are anchored;

placing a plurality of pre-cast wall panels one after another, when the square hollow section box is tightly fixed;

drilling a plurality of holes on the plurality of pre-cast wall panels in conjunction with the square hollow section box;

screwing a self tapping screw of required length on to the square hollow section box to anchor the plurality of pre-cast wall panels;

securing a first piece of the pre-cast wall panel;

applying fibrous cement of non shrink quality along the edges of the pre-cast wall panel;

jamming a second pre-cast wall panel into a mortar of the fibrous cement;

and wherein all the first pre-cast wall panels are secured by jamming the edges of all the first pre-cast wall panels;

installing service fixtures within the internal cavity portion;

sealing a top portion and a bottom portion of the first pre-cast wall panels with a water proof non shrink fibrous cement rich mix; and installing a second pre-cast wall panels on the first pre-cast wall panels to form an internal cavity portion within;

Wherein a pre-defined offset gap is provided between the edges of the first pre-cast wall panels and the edges of the second pre-cast wall panels to avoid a formation of through joints.

12. The method according to claim 11, wherein the step of anchoring the pre-cast concrete panels to the beam comprises:

aligning a first pre-cast concrete panel with the beam;

anchoring with the one or more anchor bolts;

fixing service installations within the internal cavity portion, and wherein the internal cavity portion is a cavity formed between the first pre-cast concrete panel and the second pre-cast concrete panel; and aligning a second pre-cast concrete panel with the beam and anchoring with the one or more anchor bolts.

13. The method according to claim 11, wherein the step of anchoring the pre-cast concrete panels to the floor slab comprises:

aligning a first pre-cast concrete panel with the floor beam;

anchoring with the one or more anchor bolts;

fixing service installations within the internal cavity portion; and aligning a second pre-cast concrete panel with the floor slab and anchoring with the one or more anchor bolts.

* * * * *